US006742781B1

(12) United States Patent
Bartlett

(10) Patent No.: US 6,742,781 B1
(45) Date of Patent: Jun. 1, 2004

(54) BACCARAT GAME METHODS AND ELECTRONIC DEVICE FOR PLAYING THE SAME

(76) Inventor: Lawrence E. Bartlett, 39 W. Palm Dr., Arcadia, CA (US) 91007

( * ) Notice: Subject to any disclaimer, the term of this patent is extended or adjusted under 35 U.S.C. 154(b) by 179 days.

(21) Appl. No.: 10/138,128

(22) Filed: May 1, 2002

(51) Int. Cl.[7] ..... A63F 9/24
(52) U.S. Cl. ..... 273/292; 463/12
(58) Field of Search ..... 273/292, 303, 273/148 R, 309; 463/12, 13

(56) References Cited

U.S. PATENT DOCUMENTS 5,322,295 A * 6/1994 Cabot et al. ..... 273/292
5,362,064 A * 11/1994 Lofink et al. ..... 273/292
5,529,309 A * 6/1996 Bartlett ..... 273/292
5,702,104 A * 12/1997 Malek et al. ..... 273/292
6,062,979 A * 5/2000 Inoue ..... 463/12
6,299,171 B1 * 10/2001 Mollo et al. ..... 273/292
6,446,971 B1 * 9/2002 Baranauskas ..... 273/292

* cited by examiner

*Primary Examiner*—Michael O'Neill
(74) *Attorney, Agent, or Firm*—Philip J. Anderson; Anderson & Morishita, LLC

(57) ABSTRACT

Improved Baccarat Game methods and a device for playing the games are set forth wherein players each make a wager and are dealt a two-card hand of cards. A Banker hand is dealt with two cards face down and a third card face up. Players can receive a third card to better their hand value, modulo ten. After all players have completed their hands, the Banker hand is completed based upon established rules which may or may not include the third, exposed Banker card. According to another embodiment the Banker may receive a third and fourth card face up and eliminate the higher of the two. If the banker is entitled to use a third card, the remaining card is summed with the other two Banker cards. Each Player hand and the Banker hand are compared in a manner similar to Baccarat.

16 Claims, 2 Drawing Sheets

BACCARAT GAME METHODS AND ELECTRONIC DEVICE FOR PLAYING THE SAME

FIELD OF THE INVENTION

The present invention relates to methods and devices for playing a new casino card game using playing cards and based upon a Baccarat format where card values are summed modulo ten. A two card hand is dealt to a dealer and to each player. The dealer receives at least a third card exposed to all players. Each player opts to receive a third card to improve each of their hands. Depending upon the count of the dealer's first two cards, the dealer includes the value of the third card in summing his hand. Between each player and the dealer the one with the highest hand count wins.

BACKGROUND

Baccarat is one of the many live table games played in casinos or gaming establishments. Baccarat uses a standard deck of 52 playing cards and is usually dealt from a shoe having multiple decks that have been shuffled together prior to the beginning of play.

The object of the game of Baccarat is for the bettor to successfully wager on whether the surrogate Banker hand or the surrogate Player hand is going to win, e.g. have a hand count, modulo ten, closest to the target count of 9. The bettor receives even money for his wager if he selects the winning hand and loses his wager if he selects the losing hand. Because of the rules of play of Baccarat and more particularly the pre-established draw rules, the Banker hand has a slightly higher chance of winning than does the Player's hand. Therefore, if the bettor wagers on the Banker hand and the Banker hand wins, the bettor must pay to the gaming establishment a commission (typically, 5%) of the amount the bettor wins. No commission is paid if the bettor successfully wagers on the Player hand.

As used in this specification, the term "Conventional Manner of Play of Baccarat" is as follows:

A multiple number of decks of standard playing cards, 52 in number, are used; typically eight decks are shuffled together and placed in a shoe from which the cards are dealt during the play of the game.

Each bettor makes a wager on whether the Bank's hand or the Player's hand will win. After all wagers are made, two cards are dealt from the shoe to the Bank position and two cards are dealt from the shoe to the Player position on the table layout. The cards are turned face up and the values of the Bank hand and the Player hand are determined, modulo ten.

Aces count one; Kings, Queens, Jacks and Tens count zero and the other cards count their respective face value. The suits (Spades, Hearts, Diamonds and Clubs) have no meaning in Baccarat.

The highest hand value in Baccarat is nine. All hand values range from a low of zero to a high of nine. If when the cards are added together, the total of the hand exceeds nine, then the hand value is determined modulo ten. For example, a seven and a eight total fifteen, but the hand value is five. An Ace and a nine total ten, but the hand value is zero.

A two card total of eight or nine is called a "natural"; a two card total of zero is called a "baccarat." As will be explained below, in certain situations in the play of the game, a third card will be dealt. The value of this third card is added to the total of the first two cards and a new hand value is established. Again, if the new hand total exceeds nine, the hand value is determined by subtracting ten from the total of the hand.

Prior to the deal, each bettor can make one of three wagers: 1) that the Bank hand will win; 2) that the Player hand will win; or 3) that the Bank hand and the Player hand will tie. Wagering locations are provided on the Baccarat table layout. Whichever of the Bank hand or the Player hand is closest to a total on nine is the winner.

All winning Bank hand wagers are paid off at odds of one-to-one and the house charges a five percent (5%) commission on the amount won by the bettor. For example, if a bettor wagers $100 on the Bank hand and the Bank hand wins, the bettor wins $100 and is charged a $5 commission on the amount that the bettor won. The bettor is not charged any commission on the amount of his wager.

All winning Player hand wagers are paid off at odds of one-to-one and the bettor is not charged any commission on the amount of his winnings or his wager because the house Banker hand, by virtue of the third card draw rules, has a statistical advantage over the Player hand. Winning wagers on the Tie hand bet are paid off at odds of nine-to-one or eight-to-one (depending on the gaming establishment) and the bettor is not charged any commission on the amount of his winnings or his wager since there is already a statistical advantage in favor of the house on tie wagers. If a Tie hand occurs, all wagers on the Bank hand and all wagers on the Player hand are "pushes" and the amount wagered is returned to the bettor.

Depending on the point total of the Player's hand and the Banker's hand, one more card may be dealt to either the Player's hand, the Banker's hand or both. The rules for determining whether a third card is dealt are fixed rules; there is no discretion for either the Player's hand or the Banker's hand on whether a third card is dealt.

If either the Player hand or the Banker hand has a point total of eight or nine on the first two cards, no third card is dealt to either hand and the hand with the highest point total is the winner (or the hand is a Tie, as the case may be). If neither the Player hand nor the Banker hand has a point total of eight or nine, then there is a possibility of a third card draw.

The third card draw rules are as follows:

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Bank hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

| Bank hand two card point total | Bank hand DRAWS when the Player's hand third card is: | Bank hand STANDS when the Player's hand third card is: |
|---|---|---|
| 0, 1 or 2 | Bank always draws | |
| 3 | 0, 1, 2, 3, 4, 5, 6, 7 or 9 | 8 |

-continued

| Bank hand two card point total | Bank hand DRAWS when the Player's hand third card is: | Bank hand STANDS when the Player's hand third card is: |
|---|---|---|
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | | Bank always stands |

The draw rules for Conventional baccarat are summarized in Table 1 below.

TABLE 1

BACCARAT
- - - RULES - - -
(Note: 10s the same as 0)

PLAYER

| HAVING TWO CARD TOTAL OF | |
|---|---|
| 1-2-3-4-5-10 | DRAWS A CARD |
| 6-7 | STANDS |
| 8-9 | TURNS CARDS OVER |

BANKER

| HAVING TWO CARD TOTAL OF | DRAWS WHEN PLAYER'S THIRD CARD DRAW IS AN | DOES NOT DRAW WHEN PLAYER'S THIRD CARD DRAW IS AN |
|---|---|---|
| 0, 1, 2 | ALWAYS DRAWS | |
| 3 | 1-2-3-4-5-6-7-9-10, none | 8 |
| 4 | 2-3-4-5-6-7, none | 1-8-9-10 |
| 5 | 4-5-6-7, none | 1-2-3-8-9-10 |
| 6 | 6-7 | 1-2-3-4-5-8-9-10, none |
| 7 | STANDS | |
| 8-9 | TURNS CARDS OVER | |

At the end of each hand, winning wagers are paid and losing wagers are collected by the house. Any commission due to the house is marked in commission boxes in the center of the table. Gaming chips are used to represent the amount of money owed by each bettor to the house for the commissions. In order not to slow down the game, the commission is not actually collected from each bettor until the end of the round determined by all of the cards in the shoe being dealt down to the plastic cut card, usually approximately eighty hands.

In my prior patent U.S. Pat. No. 5,529,309 issued Jun. 25, 1996 I disclosed a game based on Baccarat where the dealer resolves his hand to a final hand before any action by each player. Inoue, U.S. Pat. No. 6,062,979 issued May 16, 2000 discloses an electronic Baccarat game having a video display. Among the initial four cards dealt to player and banker, one of them is randomly hidden. Cabot et al, U.S. Pat. No. 5,322,295 issued Jun. 21, 1994 discloses a multi-hand Blackjack game where the dealer receives two cards and discards the least favorable, retaining the remaining card as an up card.

There is a need for an improved Baccarat-type game method and device which is not constrained by complicated draw rules which tend to confuse all but the most experienced players. The lack of player participation in drawing a card is still an unresolved problem in conventional Baccarat. There is also a need for a Baccarat-type game where each player wagers on their own, individual hand instead of a common Player/Banker hand, and each player has the choice to stand on their two-card hand or to draw an additional card in an attempt to improve their hand.

SUMMARY OF THE INVENTION

There is, therefore, set forth according to the present invention a Baccarat-type game which is not governed by complicated and strict third card draw rules, which provides for each of a plurality of players to play their own hand with the option to draw a third card in an attempt to better their hand and which provides for a new manner in which the dealer's hand is displayed and played and which still provides the casino with a desired profit margin.

Accordingly there is set forth an improved method for playing a Baccarat-type game a using a deck (or multiple decks) of playing cards and where hand counts are determined modulo ten and where the target hand value is nine. The improvement includes each player making a wager on their individual hand to participate in the game. A dealer representing the casino deals two cards to each player and two cards face down to a dealer position. At least one additional, third dealer card is dealt, face up, to the dealer position. Each player examines their two cards and opts to stand or receive a third player card in an attempt to improve their final, player hand, count of between 0 and 9. Upon completion of all of the players' hand(s) the dealer, according to the following rules, completes the dealer hand: (i) if the dealer position two-card count, modulo ten, is 7–9 the third dealer card is ignored and the count of the first two cards defines the dealer final hand count and (ii) if the first two card hand count is other than 7–9, the dealer sums the value of the third dealer card with the other two dealer cards, modulo ten, to define a dealer hand final count between 0 and 9. Each player's final hand count is compared to the dealer final hand count and (i) if the player final hand count is greater than the dealer's final hand count, the player wins and receives an award based on their wager, less any imposed commission, (ii) if the dealer final hand count is greater than the player's final hand count, the dealer hand wins and the player's wager is collected and (iii) declaring a tie if the player and dealer hand counts are equal. The game may provide for optional tie wagers by the players.

Other dealer two card hand counts may be used to determine when the third dealer card is to be ignored or included in summing the dealer's hand. Further, inclusion of the third dealer card, may be optional, depending upon whether the third card will improve the count of the dealer's hand.

In another embodiment, the dealer hand may be dealt a third and a fourth card face up, with the higher count of the two (with face cards and 10s considered as "10" and the highest count OR modulo ten with the foregoing valued as "0"), excluded from play.

The device according to the present invention includes a computer processor for controlling the game, a data structure storing data representing each playing card of a deck of playing cards and means for randomly selecting playing card data from said data structure. A video display is provided as well as are means for at least one player to enter a wager and prompt the play of the game. The processor is configured to, upon prompting of play, select and display two cards for each player hand and two cards face down for an initial dealer hand and a third dealer card face up. Means are provided for each player to prompt the processor to accept the cards of the initial player hand or prompt the processor to select and display an additional card for the player hand to define one of a two or three card final hand, the cards of the player final hand summed modulo ten to define a player hand final count between 0 and 9. The processor is also configured to, upon completion of all player final hand, sum the values of the cards of the initial dealer hand and (i) if the two card, modulo ten, count is 7–9 accept the count of the initial dealer hand two cards defining the dealer final hand count ignoring the third card by, for example, displaying an "X" partially through or blotting out the third card and (ii) if the two initial card hand count is other than 7–9, the processor controlling the display to include the third dealer card and sum its value with the other two dealer cards, modulo ten, to define a dealer hand final count between 0 and 9. The processor compares the player final hand count with the dealer final hand and (i) if the player final hand count is greater than the dealer's final hand count, issues an award to the player based on their wager, (ii) if the dealer final hand count is greater than the player's final hand count, collect the player's wager and (iii) declaring a tie if the player and dealer hand counts are equal.

Other dealer initial hand counts may be used to determine under what conditions the dealer third card will be included in the dealer final hand count. Further the processor may be configured to select and display a third and a fourth dealer card and eliminate from play the higher of the two third and fourth cards (with face cards and 10s considered as "10" and the highest count OR modulo ten with the foregoing valued as "0"), designating the remaining card as the dealer third card.

According to further aspects the method and device may provide for exacting a commission on player winning hands, providing for a tie wager and the like. Further, the device may be incorporated into an Internet based game provided to remote players at their respective terminals.

BRIEF DESCRIPTION OF THE DRAWINGS

These and other features and advantages will become appreciated as the same becomes better understood with reference to the description, claims and drawings wherein:

DESCRIPTION

Figure 1:
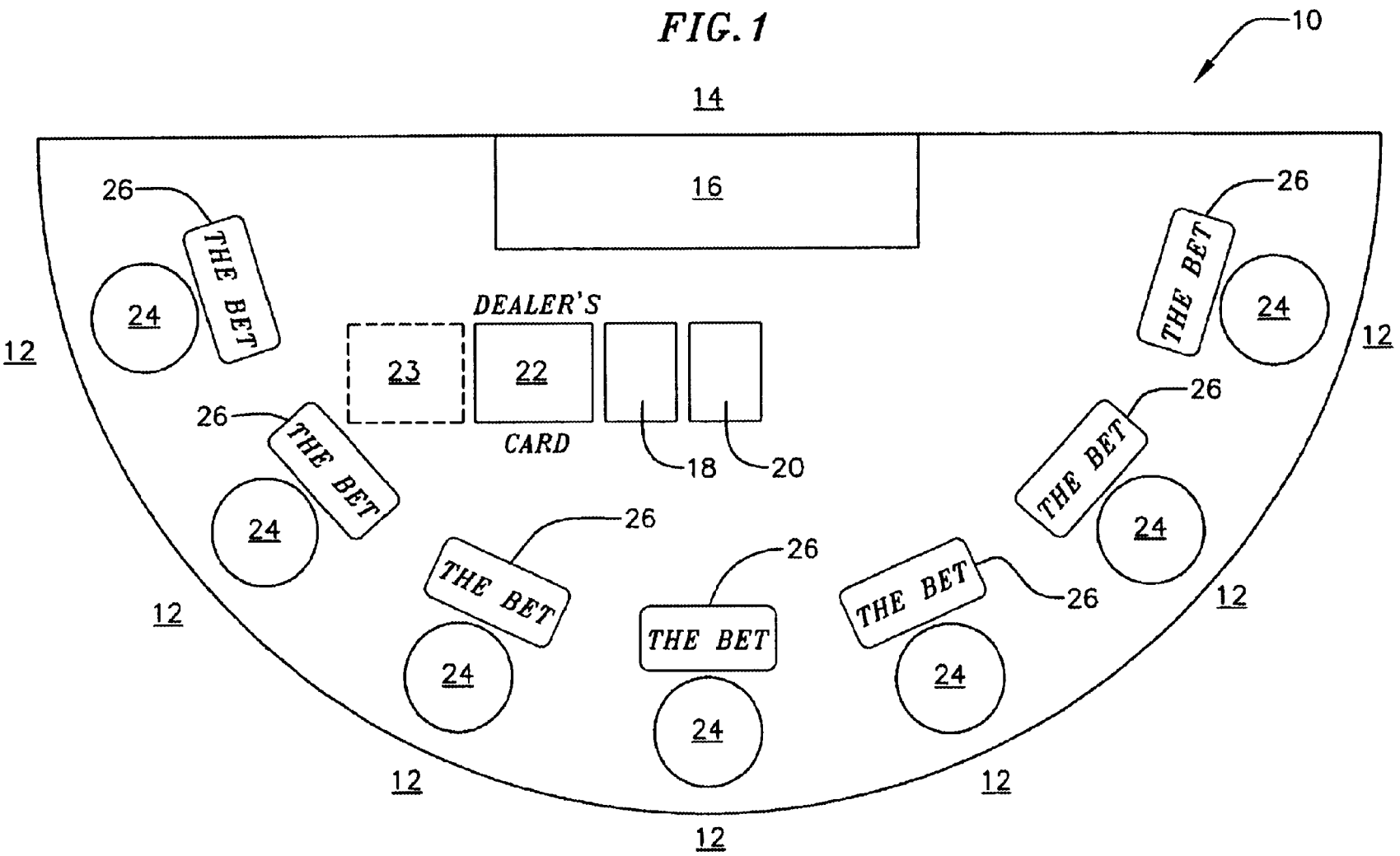
FIG. 1 shows a layout for a live version of the method of the present invention.

Turning to the drawings, FIG. 1 shows an example of a table layout 10 for the play of a live version of the game methods according to the present invention. While the layout 10 shows seven player positions 17, it should be noted that more or fewer player positions 12 could be provided. Preferably the layout 10 is adapted to fit on an existing Blackjack table top thus placing each player position 12 along an arcuate margin of the layout 10 and defining along an edge a dealer position 14. Players, up to seven, sit at each of a player position 12 with the dealer at the dealer position 14.

Disposed at the dealer position 14 is a chip tray 16 holding the game chips or "checks" used during play for players to make wagers and for the dealer to pay player winning hands.

Disposed in front of the tray 16 is a dealer hand area which may be defined by rectangular markings denoting a first dealer card area 18, second dealer card area 20 and third dealer card area 22. Shown in phantom in FIG. 1 adjacent to the third card area could be a fourth card area 23 for a further embodiment of the game method as described below. For purposes of the description of the first embodiment of the game method, the fourth card area 23 will be ignored since it would not be provided in this embodiment.

At each player position is a circle 24 or other designation (such as a casino logo, box or other marking) where each player wagers upon their hand of play to participate in the game. There may also be provided a rectangle 26 at each player position 12 to receive a player tie wager.

The method of play for the various embodiments of the game will now be described. Reference to the various embodiments is not meant to define preferred or non-preferred embodiments, but is done to distinguish between the various game methods.

According to the method of this embodiment, each player makes a wager by playing cash, tokens or script in their respective circles 24. The wagers need not be the same. If desired, the method may include and provide for tie wagers. If a tie wager is provided, any player desiring to make a tie wager places their wager in their assigned rectangle 26 indicating that they are wagering on a tie outcome.

After the wagers have been made the dealer deals two playing cards from a deck of playing cards to each player as an initial, two card playing hand, and two cards (preferably face down) to a dealer dealt into the dealer first and second card areas 18, 20 defining an initial, two-card, dealer hand. Preferably the cards of the dealer initial hand are dealt face down. The dealer also deals a third dealer card, preferably face-up, into the third dealer card area 22. Each player evaluates their initial two card player hand, modulo ten. The object is to have a hand count, as in Baccarat, of 9 or close to nine. Unlike Baccarat, each player plays their own hand and may, regardless of the count of their hand or of the dealer hand, elect to receive one additional, third player card in hope of increasing the count of their hand. The value or count of third card is summed with the initial two cards. For example if a player held a King—5 as their initial holding, the count would be five. The player may opt to draw a third card attempting to increase the hand count. If the player drew a 4, they would have a count of nine. The player, on the other hand, may elect to stand on the count of the initial two cards. The count of the two card hand (if the player stands) or the three card player hand if the player draws, defines a final player hand count between 0–9.

After all players have stood or drawn a third card, the dealer exposes his initial two card dealer hand. If the sum, modulo ten, of the first two dealer cards is 7–9, the dealer stands on that count and ignores the count of the third dealer card and the two card count becomes the final dealer hand count between 0–9. To show the player(s) that the third dealer card is not in play, the dealer may turn the third dealer card 90° or may place a lammer or button with the words "Not In Play" on top of the card. If the count of the initial two card dealer hand is 0–6, the dealer includes the count of the third dealer card to define the final dealer hand count between 0–9.

In succession the dealer compares each player hand final count to the dealer final hand count. If the dealer final hand count is higher than the player's, the dealer is the winner and the player loses their wager. Conversely, if the player's final hand count is greater than the dealer final hand count, the player wins their wager and is paid an award. The award may be a 1:1 or may be 1:1 less a commission to be paid by the play of, for example, 5% to the casino. If the dealer and player's final hand count are the same a tie outcome occurs and the player's wager is neither won nor lost. Again, if desired, the game may also include a tie wager.

The method may be modified to require to ignore the third dealer card where the initial two card dealer hand count is (i) 6–9, (ii) 5–9 or (iii) any selected count of 5, 6, 7, 8, or 9.

The method may be further modified by the dealer, when the third card is to be included in the dealer's final hand count, ignoring the count of the third dealer card only when it will decrease the dealer's hand count.

The method may be practiced with or without providing a tie wager. If there is no tie, the player loses their tie wager. Where a tie occurs, and if the player has wagered on a tie, the player wins their tie wager which may be paid at suitable odds, e.g. 10:1, 8:1 or the like.

After all wagers are settled, the cards are collected and removed from play in readiness for the next hand of play.

Another embodiment is similar to the method described above. However, according to this embodiment, the dealer deals additional third and fourth cards, face up. Counting face cards and 10s as 0 counts, the dealer as between the third and fourth dealer cards, eliminates from play the card having the higher count by placing a lammer or puck on the eliminated card, turning it face down, removing it from play or the like. The remaining, lower value card, is designated as the dealer third card for purposes of inclusion or exclusion from the dealer's final hand as described above.

Further, according to this method, the third dealer card is ignored (not included) for the dealer's final hand count where the count of the initial dealer two card hand count is a selected one of: (i) 7–9, (ii) 8–9, (iii) 6–9, (iv) 4–9, (v) 5–9 or (vi) a selected one of 5, 6, 7, 8, or 9. According to this embodiment, where the Dealer and Player have final, tie hand counts of 8 or 9, the Player may be designated as the winner.

In a variation of this embodiment, face cards and 10s may be treated as having a count of 10 for purposes of determining the higher of the third and fourth dealer cards.

In yet another embodiment of the method of the present invention, the method proceeds like the first embodiment described herein with the dealer dealing a third dealer card face up. If the two cards of the dealer's initial two card hand have a summed count of 7–9, the third card is ignored and the initial two cards define the final dealer hand. If the initial dealer hand count of the sum, modulo ten, of the first two dealer cards is 0–6, the dealer sums the count of the third card with the two initial cards and draws and adds a fourth card to define a four card dealer final hand. The values of the four cards are summed, modulo ten, to define the final dealer hand count.

According to the present invention, the various embodiments of the method provides for each player to play their own hand and opt to draw a third card without being constrained by fixed, complicated, third card draw rules.

Figure 2:
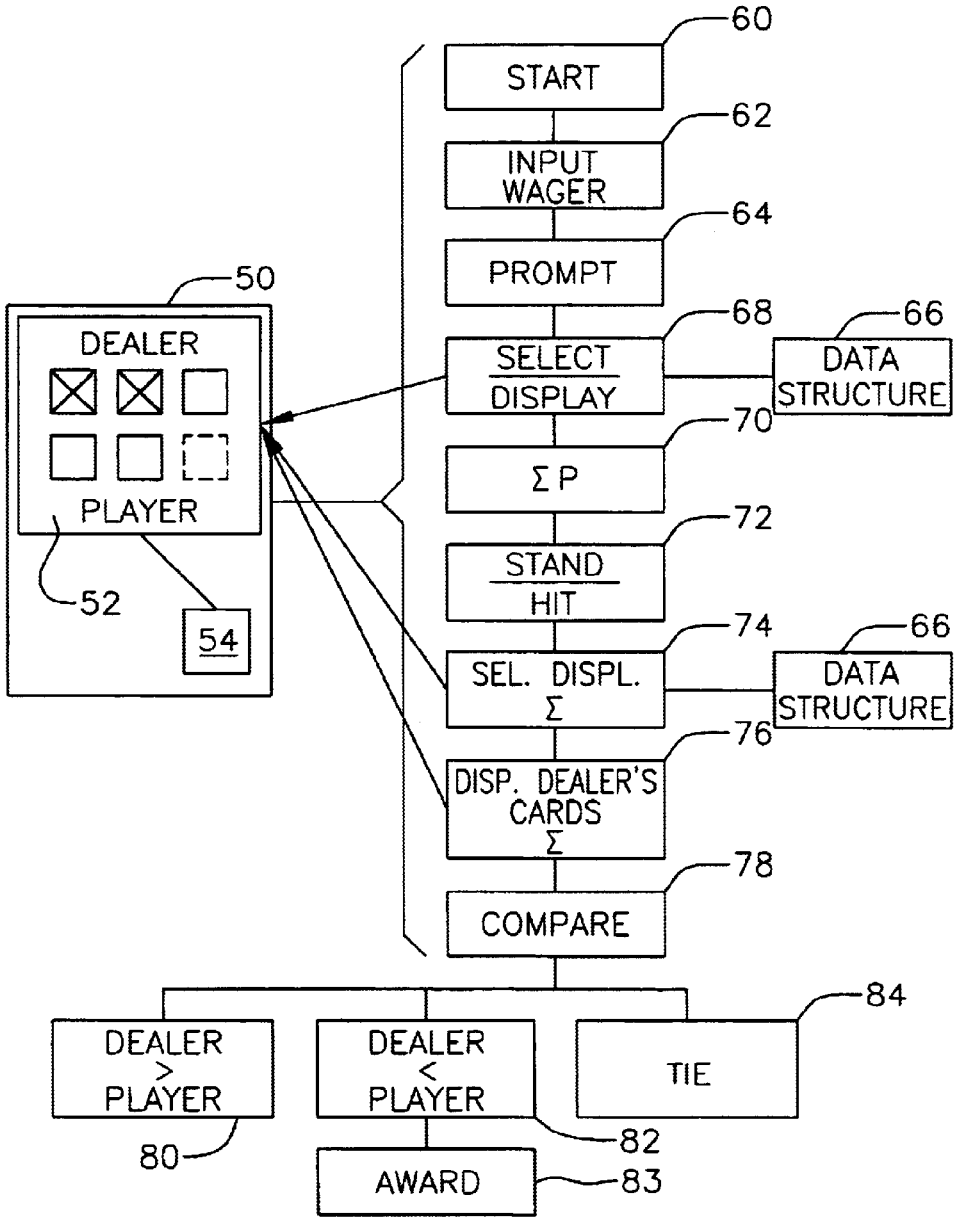
FIG. 2 shows a display and logic diagram for a device for playing the method of the present invention.

Turning to FIG. 2 there is shown a diagram for a device 50 for playing the various embodiments of the present invention. While only the first embodiment described above will be used as an example, it should be understood that any of the embodiments could be played on the device 50 configured by appropriate software. The device 50 includes an electronic display 52 to present the playing cards to a player during play of the game. The display 52 and the play of the game itself, is controlled by a processor 54 housed within the device 50. The display 52 may have the designated first, second and third dealer card areas 18, 20 and 22 as well as an area for the display of the player's hand.

With continuing reference to FIG. 2, the play of the game begins at a start 60 at which the display 52 is energized and the processor 54 is in a condition to control the play. At 62 the player inputs their desired wager to play a hand. As is known in the art, wager may be input by the player wagering gaming credits accumulated at the device 50, inserting coins or tokens, inserting cash or script at a cash reader to accumulate game credits or the like. Upon inputting the desired wager, at 64 play of the game is prompted. The processor 54 includes a random number generator as is known in the art. Also provided is a memory or data structure 66 storing data representing each card of at least one deck of playing cards. The processor 54 at 68 randomly selects and controls the display 52 to display the three cards for dealer's initial hand (the first and second cards displayed face down and the third card dealt face up) and the two initial cards for the player's hand, face up. After the two cards for the player's hand have been selected and displayed, the processor 54 at 70 sums the two cards of the player's hand, modulo ten, and preferably controls the display 52 to display for the player the count of the first two cards. At 72 the player opts to stand with the count of the first two cards or draw a third card. Control means such as control buttons, keyboard, mouse or other data input means may be used by the player to signal the processor to draw a third card or stand. In the event the player controls the processor 54 to select a third card, at 74 the processor randomly selects from the data structure 66 an additional, third card for the player's hand and sums the same with the first two cards, modulo ten, to determine the player's final hand count. Preferably the final hand count for the player is displayed at the display 52. At 76, and upon completion of the player's hand, the processor controls the display 52 to display the values of the dealer's cards. The dealer's final hand count is determined according to the method described above, i.e. under what circumstances the dealer third card is to be considered. The dealer's final hand count is displayed at the display 52.

At 78 the processor 54 compares the player's and the dealer's final hand counts. If, at 80, the dealer's hand has a higher count, e.g. an 8 versus a 5 for the player, the dealer is the winner and player's wager is lost. If, at 82, the player's final hand count is greater than the dealer's, the player wins and is paid an award 83 based upon his wager. If, at 84, the result is a tie, the wager is returned since the player neither wins nor loses their wager.

If the device 50 is to incorporate a tie wager, the player would make a tie wager prior to prompting of play at 64 and if the outcome was a tie the player would receive and award, e.g. a pay of 8:1 based upon their tie wager.

The device as described above may be adapted to include one or more players playing at individual terminals against a common, displayed, dealer hand in a manner suggested by Inoue, above. Further the device 50 may be a personal computer terminal communicating through the Internet with a remote host for play of the game method by one or more players at their remote terminals.

While I have shown and described certain embodiments of the present invention, it should be understood that the same is subject to many variations without departing from the spirit and scope of the appended claims.

I claim:

1. An improved method for playing the game of Baccarat a using a deck of playing cards and where hand counts are determined modulo ten and where the target hand value is nine, the improvement comprising:

each player making a wager to participate in the game;

dealing two cards to each player and two cards face down to a dealer;

dealing a third dealer card face up to the dealer;

each player examining their two cards and standing or receiving a third player card to define one of a two or three card final hand having a final player hand, the cards of the player final hand summed modulo ten to define a player hand final count between 0 and 9;

upon completion of all player's final hands the dealer exposing his first two cards and (i) if the two card, modulo ten, count is 7–9 ignoring the third dealer card and the two cards count defining the dealer final hand count and (ii) if the two card hand count is other than 7–9, the dealer including the value of the third dealer card with the other two dealer cards, modulo ten, to define a dealer hand final count between 0 and 9; and comparing the player final hand count with the dealer final hand and (i) if the player final hand count is greater than the dealer's final hand count, declaring the player the winner and the player receiving an award based on their wager, (ii) if the dealer final hand count is greater than the player's final hand count, declaring the dealer the winner and collecting the player's wager and (iii) declaring a tie if the player and dealer hand counts are equal.

2. The method of claim 1 comprising the dealer ignoring the dealer third card where the count of the first two dealer cards is one of (i) 6–9, (ii) 5–9 or (iii) any selected one of 5–9.

3. The method of claim 2 comprising the dealer ignoring the dealer third card if the count of the first two dealer cards is 5–9 and if the first two card hand count is 0–5, including the dealer third card on condition that the third card will increase the dealer's final hand count.

4. The method of claim 3 comprising the dealer ignoring the dealer third card where the count of the first two dealer cards is one of (i) 6–9, (ii) 5–9 or (iii) any selected one of 5–9 and where the dealer two card hand count is other than (i)–(iii) including the value of the dealer third card only where the third card value will increase the dealer's final hand count.

5. The method of claim 1 comprising exacting a commission against any declared player win award.

6. The method of claim 1 comprising dealing said third and a fourth dealer card to the dealer face up, the dealer eliminating from play, as between the third and fourth cards, the higher value card and (i) if the two card, modulo ten, count is 7–9 the two card hand count defining the dealer final hand count and (ii) if the two card hand count is other than 7–9, the dealer summing the value, modulo ten, of the remaining third or fourth dealer card with the other two dealer cards to define a dealer hand final count between 0 and 9.

7. The method of claim 6 comprising the dealer ignoring the dealer third card where the count of the first two dealer cards is one of (i) 4–9, (ii) 5–9, (ii) 6–9 or (iii) any selected one of 5–9.

8. The method of claim 6 comprising the player declared the winner in the event of a tie hand count of 8 or 9.

9. The method of claim 6 comprising assigning to face cards and tens a selected value of 0 or ten.

10. A device for playing an improved Baccarat game comprising:

a computer processor, a data structure storing data representing each playing card of a deck of playing cards and means for randomly selecting playing card data from said data structure;

a display and means for at least one player to enter a wager and prompt play of the game;

the processor configured to, upon prompting of play, select and display two cards for each player hand and two cards face down for an initial dealer hand and a third dealer card face up;

means for each player to prompt the processor to accept the cards of the initial player hand or prompt the processor to select and display an additional card for the player hand to define one of a two or three card final hand, said cards of the player final hand summed modulo ten to define a player hand final count between 0 and 9;

said processor configured to, upon completion of all player's final hand, sum the values of the cards of the initial dealer hand and (i) if the two card, modulo ten, count is 7–9 accept the count of the initial dealer hand two cards defining the dealer final hand count and (ii) if the two initial card hand count is other than 7–9, the processor controlling the display to include the third dealer card and summing the value of the third dealer card with the other two dealer cards, modulo ten, to define a dealer hand final count between 0 and 9; and said processor further configured to compare the player final hand count with the dealer final hand and (i) if the player final hand count is greater than the dealer's final hand count, issue to the player an award based on their wager, (ii) if the dealer final hand count is greater than the player's final hand count, collect the player's wager and (iii) declaring a tie if the player and dealer hand counts are equal.

11. The device of claim 10 comprising the processor configured to accept the count of the initial dealer hand as the dealer final hand count where the count of the first two dealer cards is one of (i) 6–9, (ii) 5–9 or (iii) any selected one of 5–9.

12. The device of claim 11 comprising the processor configured to sum the value of the initial dealer hand and third dealer card if the first two card hand count is a selected one of 0–5, and 0–4 where the third card value will increase the dealer's final hand count.

13. The device of claim 10 comprising the processor configured to randomly select and display at the display said third and a fourth dealer card to the dealer face up, eliminating from play, as between the third and fourth cards, the higher value card and (i) if the two card dealer hand count, modulo ten, count is 7–9 the two card hand count defining the dealer final hand count and (ii) if the two card hand count is other than 7–9, the processor summing the value, modulo ten, of the remaining third or fourth dealer card with the other two dealer cards to define a dealer hand final count.

14. The device of claim 13 comprising the processor configured to select the sum of the two card dealer hand as the dealer hand final count where the count of the first two dealer cards is one of (i) 4–9, (ii) 5–9, (ii) 6–9 or (iii) any selected one of 5–9.

15. The device of claim 13 comprising the processor configured to declare the player hand the winner in the event of a tie hand count of 8 or 9.

16. The device of claim 10 comprising the processor configured to assign to face cards and tens a selected value of 0 or ten.

* * * * *